US010639761B2

(12) United States Patent
Qiu

(10) Patent No.: US 10,639,761 B2
(45) Date of Patent: May 5, 2020

(54) GRINDING WHEEL AND GRINDING APPARATUS

(71) Applicant: DISCO CORPORATION, Tokyo (JP)

(72) Inventor: Xiaoming Qiu, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 143 days.

(21) Appl. No.: 15/708,277

(22) Filed: Sep. 19, 2017

(65) Prior Publication Data

US 2018/0079046 A1 Mar. 22, 2018

(30) Foreign Application Priority Data

Sep. 20, 2016 (JP) ..... 2016-182512

(51) Int. Cl.
*B24B 1/04* (2006.01)
*B24B 7/22* (2006.01)
*B24B 7/04* (2006.01)

(52) U.S. Cl.
CPC ..... *B24B 1/04* (2013.01); *B24B 7/04* (2013.01); *B24B 7/228* (2013.01)

(58) Field of Classification Search
CPC ..... B24B 1/04; B24B 49/003; B24B 49/10; B24B 7/04; B24B 7/228; B24B 45/00; B24D 7/06; B24D 7/066
See application file for complete search history.

(56) References Cited

U.S. PATENT DOCUMENTS 2,939,251 A * 6/1960 Greening ..... B24B 1/04 451/124
5,165,205 A * 11/1992 Nakagawa ..... B23Q 1/34 366/108
6,264,532 B1 * 7/2001 Meloni ..... B24B 37/0053 451/21
2002/0014100 A1 * 2/2002 Prokopenko ..... B24B 1/04 72/53
2003/0032377 A1 * 2/2003 Tada ..... B24B 37/015 451/285
2010/0212470 A1 * 8/2010 Ohnishi ..... B23D 61/10 83/646

(Continued)

FOREIGN PATENT DOCUMENTS

JP 2015-013321 1/2015
JP 2015013321 A * 1/2015

OTHER PUBLICATIONS

Machine translation of Aoki, JP 2015-013321 (Year: 2015).*

*Primary Examiner* — Timothy V Eley
*Assistant Examiner* — Marcel T Dion
(74) *Attorney, Agent, or Firm* — Greer Burns & Crain Ltd.

(57) ABSTRACT

A grinding wheel for grinding a wafer held on a holding table includes: a first circular annular plate mounted to a mount of a grinding apparatus; a tubular body extending downward from an outer circumference of the first circular annular plate; a second circular annular plate connected to a lower end of the tubular body; a plurality of grindstones arranged in an annular pattern on a lower surface of the second circular annular plate; an annular ultrasonic oscillation section disposed on an upper surface of the second circular annular plate so as to surround an opening; and an ultrasonic reception section that receives an ultrasonic vibration transmitted from the ultrasonic oscillation section to the grindstones.

9 Claims, 5 Drawing Sheets

(56) References Cited

U.S. PATENT DOCUMENTS

| | | | | |
|---|---|---|---|---|
| 2013/0165019 | A1* | 6/2013 | Huang | B24B 1/04 451/5 |
| 2015/0352713 | A1* | 12/2015 | Takazakura | B23B 37/00 173/2 |
| 2016/0256973 | A1* | 9/2016 | Ting | B23B 37/00 |

* cited by examiner

GRINDING WHEEL AND GRINDING APPARATUS

BACKGROUND OF THE INVENTION

Field of the Invention

The present invention relates to a grinding wheel and a grinding apparatus for grinding a wafer.

Description of the Related Art

There has been known a grinding apparatus that grinds a wafer while vibrating grindstones (see, for example, Japanese Patent Laid-open No. 2015-013321). In the grinding apparatus described in Japanese Patent Laid-open No. 2015-013321, an ultrasonic vibration is transmitted to the grindstones, thereby to ensure good biting of abrasive grains of the grindstones into a wafer that is difficult to grind. In addition, the ultrasonic vibration reduces grinding load, whereby dulling and the like of the grindstones are prevented, leading to a prolonged life of the grindstones. In this kind of grinding apparatus, normally, the grinding feed speed is raised at the time of starting grinding and is lowered as the thickness of the wafer approaches a finished thickness, whereby the wafer can be ground without leaving damage in the wafer.

SUMMARY OF THE INVENTION

However, immediately after the start of grinding, grinding feed speed is high, so that the touch of the grindstones on the wafer is strong and the grinding load is high. Since the vibration of the grindstones is suppressed by the wafer, there has been the problem that loading and/or dulling occurs to hamper favorable grinding, notwithstanding the ultrasonic vibration is transmitted to the grindstones. On the other hand, immediately before the end of grinding, the grinding feed speed is lowered, so that the touch of the grindstones on the wafer is weak and the grinding load is low; in this case, however, there has been the problem that the wafer is ground excessively due to the vibration of the grindstones. Thus, it has been impossible to achieve appropriate grinding of a wafer according to the conditions of grinding.

Accordingly, it is an object of the present invention to provide a grinding wheel and a grinding apparatus by which favorable grinding of a wafer can be achieved through appropriate transmission of an ultrasonic vibration to grindstones.

In accordance with an aspect of the present invention, there is provided a grinding wheel for grinding a wafer held on a holding table by transmitting an ultrasonic vibration to a plurality of grindstones arranged in an annular pattern, the grinding wheel including: a first circular annular plate having an annular mounted surface to be mounted to a mount of a grinding apparatus; a tubular body extending downward from an outer circumference of the first circular annular plate; a second circular annular plate connected to a lower end of the tubular body and having an opening in a center; the plurality of grindstones arranged in the annular pattern on a lower surface of the second circular annular plate; an annular ultrasonic oscillation section disposed on an upper surface of the second circular annular plate so as to surround the opening; and an ultrasonic reception section for receiving the ultrasonic vibration transmitted from the ultrasonic oscillation section to the grindstones, the ultrasonic reception section being disposed on the upper surface of the second circular annular plate.

According to this configuration, the ultrasonic vibration is transmitted from the ultrasonic oscillation section to the grindstones through the second circular annular plate, and the wafer on the holding table is ground while vibrating grinding surfaces of the grindstones. In this case, when the ultrasonic vibration is transmitted from the ultrasonic oscillation section to the second circular annular plate, the amplitude of the ultrasonic vibration received by the ultrasonic reception section varies according to the grinding condition of the grindstones arranged on the second circular annular plate. Specifically, the amplitude decreases when the touch of the grindstones on the wafer is strong, and the amplitude increases when the touch of the grindstones on the wafer is weak. Therefore, where the ultrasonic vibration transmitted to the grindstones is received by the ultrasonic reception section, it is thereby possible to appropriately control the amplitude of the ultrasonic vibration of the ultrasonic oscillation section.

In accordance with another aspect of the present invention, there is provided a grinding apparatus including: a holding table that holds a wafer by a holding surface; a grinding unit for grinding the wafer held by the holding table, the grinding unit having a mount to which a grinding wheel is mounted rotatably; and a grinding feeding unit for grinding feed of the grinding unit in a vertical direction relative to the holding surface. The grinding wheel includes: a first circular annular plate having an annular mounted surface to be mounted to a mount of a grinding apparatus; a tubular body extending downward from an outer circumference of the first circular annular plate; a second circular annular plate connected to a lower end of the tubular body and having an opening in a center; a plurality of grindstones arranged in an annular pattern on a lower surface of the second circular annular plate; an annular ultrasonic oscillation section disposed on an upper surface of the second circular annular plate so as to surround the opening; and an ultrasonic reception section that receives the ultrasonic vibration transmitted from the ultrasonic oscillator to the grindstones, the ultrasonic reception section being disposed on the upper surface of the second circular annular plate. The grinding apparatus further includes: a high-frequency power source that supplies high-frequency electric power to the ultrasonic oscillator section of the grinding wheel; and a control unit that controls the electric power supplied from the high-frequency power source according to amplitude of the ultrasonic vibration that is oscillated by the ultrasonic oscillation section, is transmitted to the grindstones and is received by the ultrasonic reception section.

According to the present invention, favorable grinding of a wafer can be achieved, by controlling the amplitude of the ultrasonic vibration according to the vibrating condition of the grindstones during grinding.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
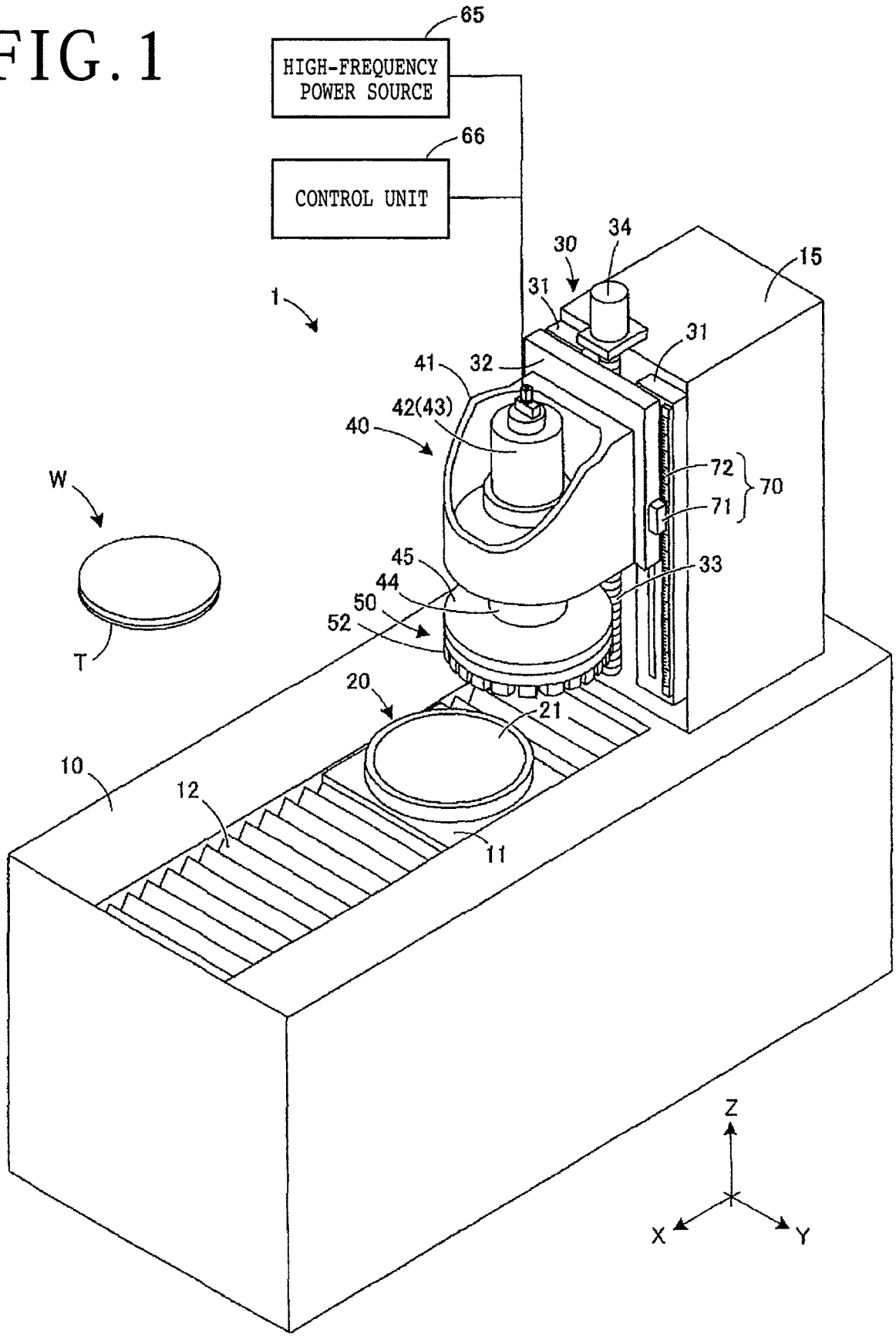
FIG. 1 is a perspective view of a grinding apparatus according to an embodiment of the present invention.

A grinding apparatus according to an embodiment of the present invention will be described below, referring to the attached drawings. FIG. 1 is a perspective view of the grinding apparatus according to this embodiment. The grinding apparatus is not limited to an apparatus configuration for exclusive use for grinding as depicted in FIG. 1, and may be incorporated in a full-automatic type processing apparatus in which grinding processing, polishing processing, cleaning processing, and the like are performed fully automatically.

As illustrated in FIG. 1, the grinding apparatus 1 is configured to apply ultrasonic grinding to a wafer W held on a holding table 20, by use of a grinding wheel 50 in which a multiplicity of grindstones 52 are arranged in an annular pattern. The wafer W is fed into the grinding apparatus 1 with a protective tape T adhered thereto, and is held on the holding table 20 through the protective tape T. Note that it is sufficient that the wafer W is any plate-shaped member to be ground; for example, it may be a semiconductor wafer of silicon, gallium arsenide or the like, it may be an optical device wafer of a ceramic, glass, sapphire or the like, or it may be an as-sliced wafer before formation of device patterns.

An upper surface of a base 10 of the grinding apparatus 1 is formed with a rectangular opening extending in an X-axis direction, and the opening is covered with a movable plate 11, which is movable together with the holding table 20, and a bellows-like waterproof cover 12. Ball screw type advancing/retracting means (not depicted) for moving the holding table 20 in the X-axis direction is provided under the waterproof cover 12. The holding table 20 is connected to rotating means (not depicted), and can be rotated by driving of the rotating means. In addition, the upper surface of the holding table 20 is formed with a holding surface 21 for suction holding the wafer W, by use of a porous material.

A column 15 on the base 10 is provided with grinding feeding means 30 for grinding feed of grinding means (grinding unit) 40 in a vertical direction (Z-axis direction) relative to the holding surface 21 of the holding table 20. The grinding feeding means 30 includes a pair of guide rails 31 disposed on the column 15 in parallel to a Z-axis direction, and a Z-axis table 32 which is slidably disposed on the pair of guide rails 31 and is driven by a motor. The Z-axis table 32 is formed on a back side thereof with nut parts (not depicted), and a ball screw 33 is in screw engagement with the nut parts. The ball screw 33 is driven to rotate by a driving motor 34 connected to one end of the ball screw 33, whereby the grinding means 40 is moved in the Z-axis direction along the guide rails 31.

The grinding means 40 is mounted to a front surface of the Z-axis table 32 through a housing 41, and is so configured that a grinding wheel 50 is rotated about a center axis by a spindle unit 42. The spindle unit 42 is a so-called air spindle, by which a spindle shaft 44 is rotatably supported through high-pressure air inside a casing 43. A mount 45 is connected to a tip of the spindle shaft 44, and the grinding wheel 50 in which a multiplicity of grindstones 52 are arranged in an annular pattern is mounted to the mount 45. The grindstones 52 are each formed by binding diamond abrasive grains with a binder such as a metal bond or resin bond.

The height position of the grinding means 40 is measured by a linear scale 70. The linear scale 70 measures the height position of the grinding means 40 by a method in which graduations of a scale section 72 provided on a surface of the guide rail 31 are read by a reading section 71 provided on the Z-axis table 32. In addition, the grinding apparatus 1 is provided with a control unit 66 that performs integrated control of various components of the apparatus. The control unit 66 is composed of a processor for carrying out various kinds of processing, a memory and the like. The memory is composed of one or a plurality of storage media such as read only memory (ROM) and random access memory (RAM) according to the use.

Besides, the grinding means 40 is provided with an ultrasonic oscillation section 58 (see FIG. 2) for generating an ultrasonic vibration in the grinding wheel 50, and the ultrasonic oscillation section 58 is supplied with high-frequency electric power from a high-frequency power source 65. In the grinding apparatus 1 configured in this way, while the ultrasonic vibration generated in the grinding wheel 50 is being transmitted to the grindstones 52 to vibrate grinding surfaces of the grindstones 52, the grindstones 52 are pressed against the wafer W to grind the wafer W, whereby the wafer W is thinned to a finished thickness set as a target. In this instance, such a control is performed that the grinding feed speed is raised immediately after the start of grinding and is lowered immediately before reaching the finished thickness, so as to prevent damage from being left in the wafer W after the grinding.

Meanwhile, in grinding of a wafer by a general grinding apparatus, the grinding feed speed is high immediately after the start of grinding, so that the grindstones with the ultrasonic vibration transmitted thereto is pressed firmly against the wafer W. When the touch of the grindstones on the wafer W becomes stronger, the vibration of the grindstones is suppressed by the wafer W, so that dulling or the like occurs at the grinding surfaces of the grindstones, and the effect of ultrasonic grinding cannot be obtained sufficiently. Therefore, immediately after the start of grinding when the grinding feed speed is high, it is preferable to control the output of the high-frequency voltage to a raised level such that the amplitude of the vibration of the grindstones is increased.

On the other hand, immediately before the end of grinding, the grinding feed speed is low, so that the touch of the grindstones on the wafer W is weak. If the grindstones are vibrated at the same amplitude as that immediately after the start of grinding, the wafer W would be ground excessively by the grindstones and damage would be left in the wafer W. Therefore, immediately before the end of grinding when the grinding feed speed is low, it is preferable to control the output of the high-frequency voltage to a lowered level such that the amplitude of the vibration of the grindstones is decreased. In this case, appropriate output conditions of the high-frequency voltage according to the grinding feed speed can be found out experimentally, but this approach needs repeating experiments multiple times, which is bothersome.

In view of this, in the grinding apparatus 1 according to this embodiment, the amplitude of vibration of the grindstones 52 is detected during grinding of the wafer W, and the output of the high-frequency power source 65 is controlled in such a manner that the amplitude of vibration of the grindstones 52 approaches target amplitude. This ensures that even when the touch of the grindstones 52 on the wafer W varies according to the grinding feed speed of the grinding means 40, the output of the high-frequency power source 65 is controlled according to the grinding feed speed and, therefore, vibration of the grindstones 52 can be continued at appropriate amplitude. Consequently, favorable ultrasonic grinding of the wafer W can be performed by the grindstones 52, from the start to the end of grinding.

Figure 2:
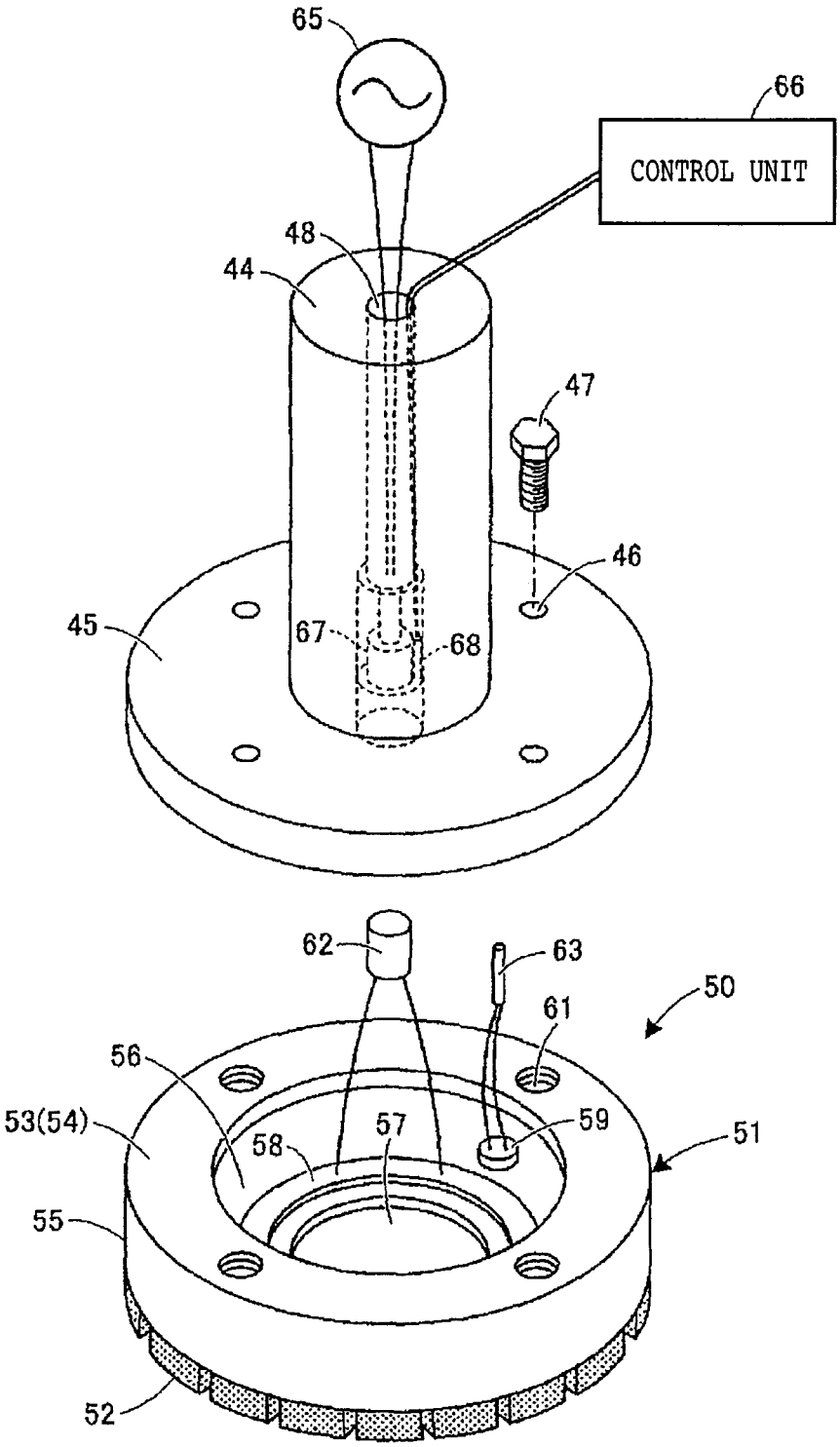
FIG. 2 is an exploded perspective view of grinding means in this embodiment.
Figure 3:
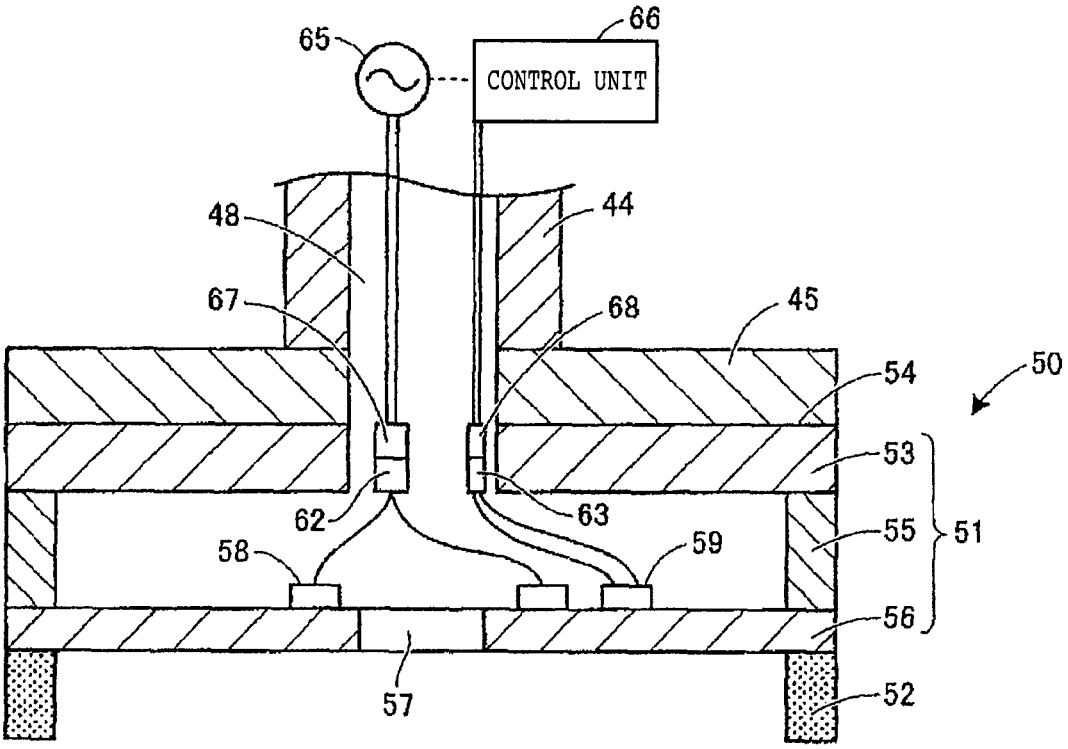
FIG. 3 is a schematic sectional view of the grinding means in this embodiment.

Now, referring to FIGS. 2 and 3, the grinding wheel according to this embodiment will be described below. FIG. 2 is a perspective view of the grinding means according to this embodiment. FIG. 3 is a schematic sectional view of the grinding means according to this embodiment. Note that in FIGS. 2 and 3, the casing is omitted from the spindle, for convenience of explanation.

As illustrated in FIGS. 2 and 3, the grinding wheel 50 has a plurality of grindstones 52 arranged in an annular pattern on the lower surface of a wheel base 51, and an ultrasonic vibration is transmitted to the grindstones 52 from an ultrasonic oscillation section 58 provided in the wheel base 51. An upper wall of the wheel base 51 is formed in an annular shape by a first circular annular plate 53, and an upper surface of the first circular annular plate 53 constitutes a mounted surface 54 to be mounted to the mount 45 of the grinding apparatus 1 (see FIG. 1). The mounted surface 54 of the first circular annular plate 53 is formed with a plurality of threaded holes 61, and tips of bolts 47 inserted into through-holes 46 in the mount 45 are screw engaged with the threaded holes 61, whereby the grinding wheel 50 is fixed to the mount 45.

A side wall of the wheel base 51 is formed in a hollow cylindrical shape by a tubular body 55 extending downward from an outer circumference of the first circular annular plate 53, and a bottom wall of the wheel base 51 is formed in an annular shape by a second circular annular plate 56 connected to a lower end of the tubular body 55. A plurality of grindstones 52 are arranged in an annular pattern on a lower surface of the second circular annular plate 56, whereas an annular ultrasonic oscillation section 58 is provided on an upper surface of the second circular annular plate 56 in such a manner as to surround a central opening 57. In addition, a circular ultrasonic reception section 59 for receiving on the second circular annular plate 56 the ultrasonic vibration transmitted from the ultrasonic oscillation section 58 to the grindstones 52 is provided on the upper surface of the second circular annular plate 56, at a position on a radially outer side of the ultrasonic oscillation section 58.

The spindle shaft 44 is formed with a through-hole 48 in an axial center thereof, and wirings for the high-frequency power source 65 and the control unit 66 are disposed in the through-hole 48. Connectors 67 and 68 for the high-frequency power source 65 and the control unit 66 are disposed on a lower end side of the through-hole 48, a connector 62 of the ultrasonic oscillation section 58 is connected to the connector 67 for the high-frequency power source 65, and a connector 63 of the ultrasonic reception section 59 is connected to the connector 68 for the control unit 66. With this configuration, high-frequency electric power is supplied from the high-frequency power source 65 to the ultrasonic oscillation section 58, and an electrical signal corresponding to the amplitude of the ultrasonic vibration received by the ultrasonic reception section 59 is outputted to the control unit 66.

The ultrasonic oscillation section 58 is composed of an ultrasonic transducer such as a piezoelectric element, and vibrates by contracting and expanding in the radial direction according to the high-frequency voltage from the high-frequency power source 65. With the radial contraction and expansion of the ultrasonic oscillation section 58 repeated, an ultrasonic vibration is transmitted from the ultrasonic oscillation section 58 to the grindstones 52 through the second circular annular plate 56. The ultrasonic reception section 59 is composed of an ultrasonic transducer such as a piezoelectric element which is the same as or similar to the ultrasonic oscillation section 58, and it converts the ultrasonic vibration of the second circular annular plate 56 into an electrical signal (voltage) and outputs the electrical signal to the control unit 66. The control unit 66 controls the output of the high-frequency power source 65, based on the amplitude of the ultrasonic vibration received by the ultrasonic reception section 59.

In this case, the output of the high-frequency power source 65 is controlled to a raised level immediately after the start of grinding when the amplitude of vibration of the grindstones 52 decreases, and the output of the high-frequency power source 65 is controlled to a lowered level immediately before the end of grinding when the amplitude of vibration of the grindstones 52 increases. This ensures that favorable grinding of the wafer W can be performed from the start to the end of grinding, while maintaining appropriate amplitude of vibration of the grindstones 52, irrespectively of the condition of the touch of the grindstones 52 on the wafer W. Note that although a vibration is generated also due to the grinding of the wafer W, this vibration is quite different in frequency from the ultrasonic vibration transmitted to the grindstones 52, and can therefore be separated by the control unit 66.

Figure 4A:
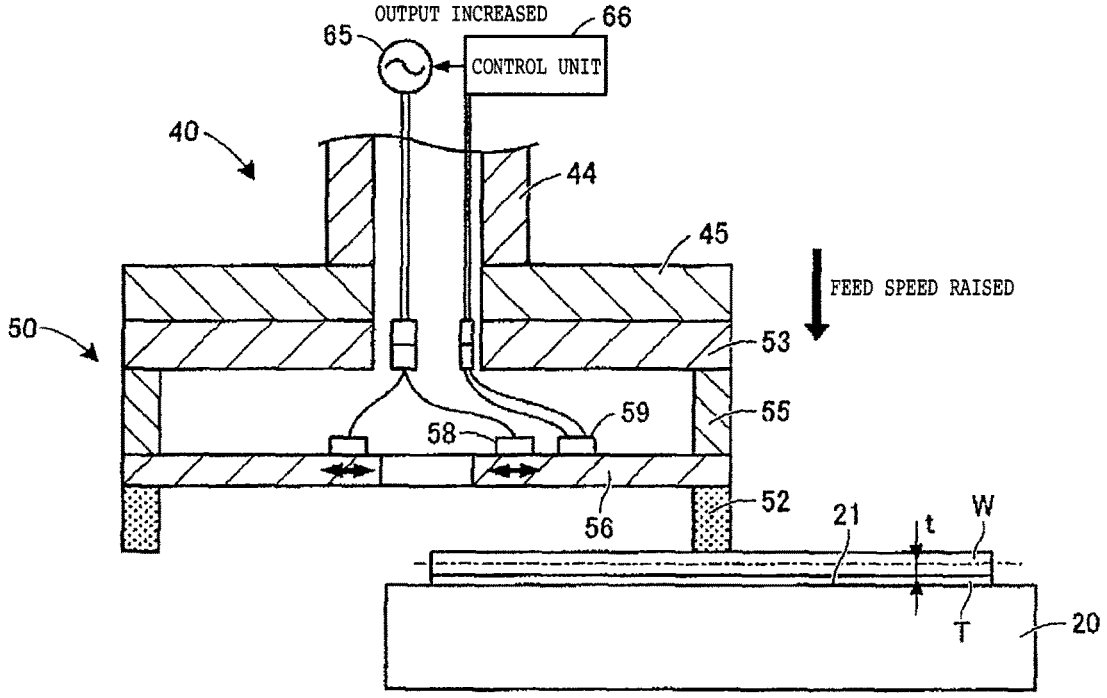
FIGS. 4A and 4B are sectional views depicting an example of a grinding operation by the grinding apparatus according to this embodiment.
Figure 4B:
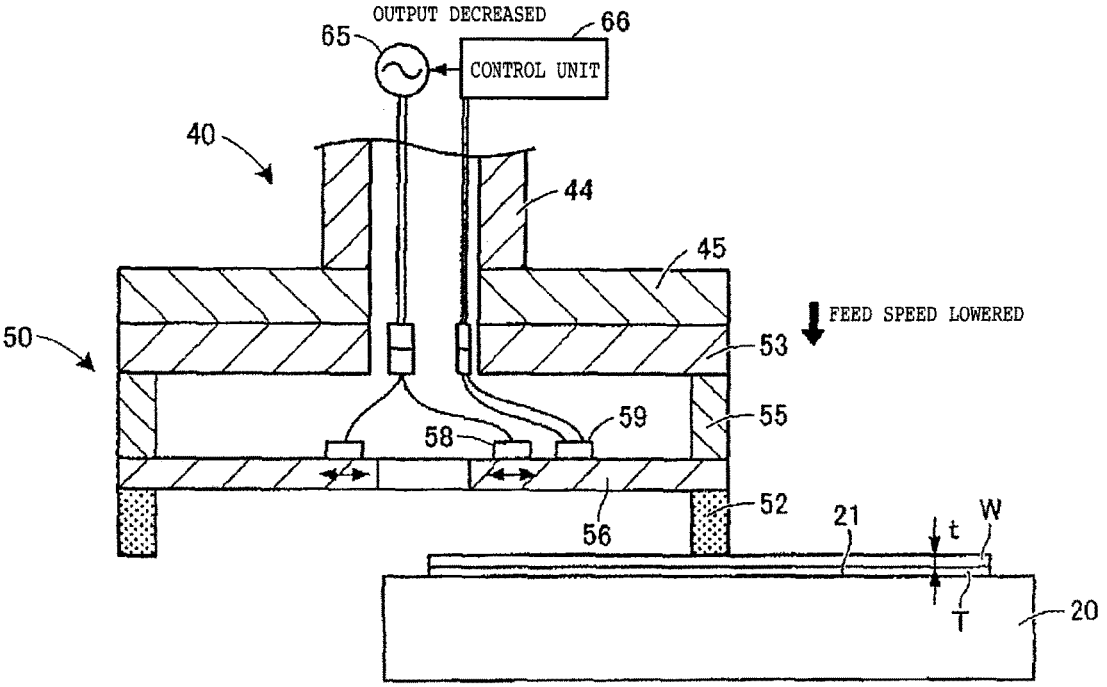

Referring to FIGS. 4A and 4B, a grinding operation will be described. FIG. 4A depicts an example of an operation immediately after the start of grinding, and FIG. 4B depicts an example of an operation immediately before the end of grinding. As depicted in FIG. 4A, the wafer W is placed on the holding table 20, and the wafer W is held by a suction force of the holding surface 21 of the holding table 20. In addition, the holding table 20 is positioned beneath the grinding means 40, the holding table 20 is rotated, and the grinding wheel 50 of the grinding means 40 is rotated at a high speed. Besides, high-frequency electric power is supplied from the high-frequency power source 65 to the ultrasonic oscillation section 58, and an ultrasonic vibration of the ultrasonic oscillation section 58 is transmitted through the second circular annular plate 56 to the grindstones 52. Then, the grindstones 52 of the grinding wheel 50 are abutted against the wafer W, and are put to grinding feed at a predetermined grinding feed speed.

Immediately after the start of grinding, the grinding feed speed of the grinding means 40 is high, so that the grindstones 52 are firmly pressed against the wafer W. In this instance, the ultrasonic vibration transmitted from the ultrasonic oscillation section 58 to the grindstones 52 is received by the ultrasonic reception section 59 on the second circular annular plate 56, and is outputted to the control unit 66 on a real-time basis. The control unit 66 increases the output of the high-frequency power source 65 in such a manner that the amplitude of the ultrasonic vibration received by the ultrasonic reception section 59 approaches target amplitude. Therefore, even immediately after the start of grinding when the touch of the grindstones 52 on the wafer W is strong, the amplitude of vibration of the grindstones 52 is brought closer to the target amplitude, whereby favorable grinding of the wafer W can be achieved.

As the wafer W is brought closer to the finished thickness t by grinding, as depicted in FIG. 4B, the grinding feed speed of the grinding means 40 is lowered, and the touch of the grindstones 52 on the wafer W weakens gradually. In view of this, in order that the amplitude of the ultrasonic vibration received by the ultrasonic reception section 59 does not increase, the output of the high-frequency power source 65 is lowered by the control unit 66 in such a manner that the amplitude of vibration of the grindstones 52 approaches the target amplitude. Consequently, even immediately before the end of grinding when the touch of the grindstones 52 on the wafer W is weak, the amplitude of vibration of the grindstones 52 is brought closer to the target amplitude, whereby favorable grinding of the wafer W can be achieved.

Since the vibration of the grindstones 52 received by the ultrasonic reception section 59 is constantly fed back to the control unit 66 and the output of the high-frequency power source 65 to the ultrasonic oscillation section 58 is controlled, favorable grinding of the wafer W can be achieved irrespectively of the grinding feed speed. Note that a configuration in which such a control as to bring the amplitude of the ultrasonic vibration closer to target amplitude is adopted in this embodiment, the target amplitude may be variable according to the grinding feed speed. Specifically, the target amplitude immediately after the start of grinding when the grinding feed speed is high and that immediately before the end of grinding when the grinding feed speed is low may be different from each other. Such a setting enables more favorable grinding of the wafer W.

As has been described above, according to the grinding apparatus 1 of this embodiment, the ultrasonic vibration is transmitted from the ultrasonic oscillation section 58 to the grindstones 52 through the second circular annular plate 56, and the wafer W on the holding table 20 is ground while vibrating the grinding surfaces of the grindstones 52. In this instance, when the ultrasonic vibration is transmitted from the ultrasonic oscillation section 58 to the second circular annular plate 56, the amplitude of the ultrasonic vibration received by the ultrasonic reception section 59 varies according to the grinding condition of the grindstones 52 arranged on the second circular annular plate 56. Specifically, the amplitude decreases when the touch of the grindstones 52 on the wafer W is strong, and the amplitude increases when the touch of the grindstones 52 on the wafer W is weak. Where the ultrasonic vibration transmitted to the grindstones 52 is received by the ultrasonic reception section 59, therefore, it is possible to appropriately control the amplitude of the ultrasonic vibration of the ultrasonic oscillation section 58 and thereby to grind the wafer W favorably.

Figure 5:
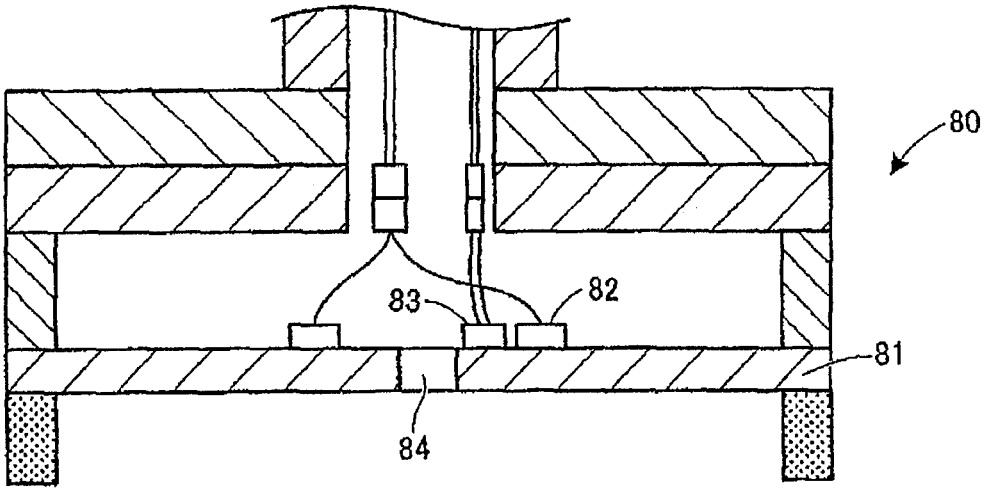
FIG. 5 is a schematic sectional view of grinding means according to a modification.

Note that the ultrasonic reception section 59 is disposed on the second circular annular plate 56 at a position on the radially outer side of the annular ultrasonic oscillation section 58 in this embodiment, but this configuration is not restrictive. It is sufficient that the ultrasonic reception section is disposed at such a position that the ultrasonic vibration transmitted from the ultrasonic oscillation section to the grindstones can be received. For example, as in a grinding wheel 80 according to a modification depicted in FIG. 5, an ultrasonic reception section 83 may be disposed on a second circular annular plate 81 at a position on the radially inner side of an annular ultrasonic oscillation section 82. In this case, the second circular annular plate 81 is formed with an opening 84 in the center thereof, and an inner circumferential edge of the second circular annular plate 81 is a free end, so that a portion inside the ultrasonic oscillation section 82 is easier to vibrate than a portion outside the ultrasonic oscillation section 82. Therefore, by disposing the ultrasonic reception section 83 on the radially inner side of the ultrasonic oscillation section 82, it is possible to enhance reception sensitivity of the ultrasonic reception section 83.

While the ultrasonic oscillation section 58 is composed of an annularly shaped piezoelectric element in this embodiment, this configuration is not restrictive. The ultrasonic oscillation section may be composed of a plurality of piezoelectric elements arranged in an annular pattern with gaps therebetween in such an extent that the piezoelectric elements can be regarded as an annularly shaped piezoelectric element. Besides, the ultrasonic oscillation section 58 is not limited to a piezoelectric element, so long as it can oscillate an ultrasonic vibration.

While the ultrasonic oscillation section 58 is configured to perform ultrasonic vibration in the manner of contracting and expanding in the radial direction thereof in this embodiment, this configuration is not limitative. The ultrasonic oscillation section 58 may be configured to perform ultrasonic vibration in the manner of contracting and expanding in the thickness direction thereof.

While the ultrasonic reception section 59 is composed of a circularly shaped piezoelectric element, this configuration is not restrictive. The external shape of the ultrasonic reception section is not particularly limited, so long as the ultrasonic reception section can receive an ultrasonic vibration. In addition, the ultrasonic reception section is not restricted to a piezoelectric element, so long as it can receive an ultrasonic vibration.

While a ball screw type moving mechanism has been described as an example of the grinding feeding means (grinding feeding unit) 30 in this embodiment, this configuration is not limitative. It is sufficient that the grinding feeding means can perform grinding feed of the grinding means in the direction perpendicular to the holding surface of the holding table, and the grinding feeding means may be composed, for example, of a linear motor type moving mechanism or a rack-and-pinion type moving mechanism.

In addition, the embodiment and modifications of the present invention are not limited to the above-described embodiments, and various changes, substitutions and modifications may be made without departing from the gist of the technical thought of the present invention. Further, if the technical thought of the present invention can be embodied in other ways by the advance of technology or by another derived technology, the present invention may be carried out by the relevant method. Therefore, the appended claims cover all the embodiments that can fall within the scope of the technical thought of the present invention.

As has been described above, the present invention has an advantageous effect to enable favorable grinding of a wafer through appropriate transmission of an ultrasonic vibration to grindstones, and is particularly useful for a grinding wheel and a grinding apparatus for use in grinding of a hard wafer of sapphire, silicon carbide or the like.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A grinding wheel for grinding a wafer held on a holding table by transmitting an ultrasonic vibration to a plurality of grindstones arranged in an annular pattern, the grinding wheel comprising:

a first circular annular plate having an annular mounted surface to be mounted to a mount of a grinding apparatus;

a tubular body extending downward from an outer circumference of the first circular annular plate;

a second circular annular plate connected to a lower end of the tubular body and having an opening in a center;

the plurality of grindstones arranged in the annular pattern on a lower surface of the second circular annular plate;

an annular ultrasonic oscillation section for transmitting ultrasonic vibration to the grindstones, disposed on an upper surface of the second circular annular plate so as to surround the opening; and an ultrasonic reception section for receiving the ultrasonic vibration transmitted from the ultrasonic oscillation section to the grindstones, the ultrasonic reception section being disposed on the upper surface of the second circular annular plate, wherein said ultrasonic reception section is disposed radially outwardly of said annular ultrasonic oscillation section.

2. The grinding wheel according to claim 1, wherein said ultrasonic reception section is configured to be rotated with the grinding wheel.

3. A grinding apparatus comprising:

a holding table that holds a wafer by a holding surface;

a grinding unit for grinding the wafer held by the holding table, the grinding unit having a mount to which a grinding wheel is mounted rotatably; and a grinding feeding unit for grinding feed of the grinding unit in a vertical direction relative to the holding surface, wherein the grinding wheel includes:

a first circular annular plate having an annular mounted surface to be mounted to a mount of a grinding apparatus;

a tubular body extending downward from an outer circumference of the first circular annular plate;

a second circular annular plate connected to a lower end of the tubular body and having an opening in a center;

a plurality of grindstones arranged in an annular pattern on a lower surface of the second circular annular plate;

an annular ultrasonic oscillation section transmitting ultrasonic vibration to the grindstones, disposed on an upper surface of the second circular annular plate so as to surround the opening; and an ultrasonic reception section that receives the ultrasonic vibration transmitted from the ultrasonic oscillator to the grindstones, the ultrasonic reception section being disposed the upper surface of the second circular annular plate, and the grinding apparatus further comprises:

a high-frequency power source that supplies high-frequency electric power to the ultrasonic oscillator section of the grinding wheel; and a control unit that controls the electric power supplied from the high-frequency power source according to amplitude of the ultrasonic vibration that is oscillated by the ultrasonic oscillation section, is transmitted to the grindstones and is received by the ultrasonic reception section.

4. The grinding apparatus according to claim 3, wherein the control unit is configured such that amplitude of the ultrasonic vibration transmitted from the ultrasonic oscillation section to the grindstones is decreased when a touch of the grindstones on the wafer is strong and the amplitude is increased when the touch of the grindstones on the wafer is weak.

5. The grinding apparatus according to claim 3, wherein said ultrasonic reception section is disposed radially outwardly of said annular ultrasonic oscillation section.

6. The grinding apparatus according to claim 3, wherein said ultrasonic reception section is disposed radially inwardly of said annular ultrasonic oscillation section.

7. The grinding wheel according to claim 3, wherein said ultrasonic reception section is configured to be rotated with the grinding wheel.

8. A grinding wheel for grinding a wafer held on a holding table by transmitting an ultrasonic vibration to a plurality of grindstones arranged in an annular pattern, the grinding wheel comprising:

a first circular annular plate having an annular mounted surface to be mounted to a mount of a grinding apparatus;

a tubular body extending downward from an outer circumference of the first circular annular plate;

a second circular annular plate connected to a lower end of the tubular body and having an opening in a center;

the plurality of grindstones arranged in the annular pattern on a lower surface of the second circular annular plate;

an annular ultrasonic oscillation section transmitting ultrasonic vibration to the grindstones, disposed on an upper surface of the second circular annular plate so as to surround the opening; and an ultrasonic reception section for receiving the ultrasonic vibration transmitted from the ultrasonic oscillation section to the grindstones, the ultrasonic reception section being disposed on the upper surface of the second circular annular plate, wherein said ultrasonic reception section is disposed radially inwardly of said annular ultrasonic oscillation section.

9. The grinding wheel according to claim 8, wherein said ultrasonic reception section is configured to be rotated with the grinding wheel.

* * * * *